US009644811B2

(12) United States Patent
Tajima

(10) Patent No.: US 9,644,811 B2
(45) Date of Patent: May 9, 2017

(54) VEHICULAR HEADLAMP

(71) Applicant: KOITO MANUFACTURING CO., LTD., Tokyo (JP)

(72) Inventor: Takehiko Tajima, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 242 days.

(21) Appl. No.: 14/228,940

(22) Filed: Mar. 28, 2014

(65) Prior Publication Data

US 2014/0293635 A1 Oct. 2, 2014

(30) Foreign Application Priority Data

Mar. 29, 2013 (JP) ..... 2013-073206

(51) Int. Cl.
*F21S 8/10* (2006.01)

(52) U.S. Cl.
CPC ..... *F21S 48/1317* (2013.01); *F21S 48/1159* (2013.01); *F21S 48/1352* (2013.01); *F21S 48/1382* (2013.01); *F21S 48/1388* (2013.01); *F21S 48/145* (2013.01); *F21S 48/328* (2013.01)

(58) Field of Classification Search
CPC ..... F21S 48/1317; F21S 48/1388; F21S 48/1159; F21S 48/1352
See application file for complete search history.

(56) References Cited

U.S. PATENT DOCUMENTS 8,858,049 B2 * 10/2014 Sekiguchi et al. ..... 362/517
2010/0110715 A1 5/2010 Nakada
2010/0118559 A1 * 5/2010 Nakada ..... 362/539
2010/0309679 A1 * 12/2010 Yamagata et al. ..... 362/539

FOREIGN PATENT DOCUMENTS

JP 2010-073431 A 4/2010
JP 2010-108727 A 5/2010
JP 2010-123473 A 6/2010
JP 2010-129322 A 6/2010
JP 2010-153259 A 7/2010
JP 2013-045681 A 3/2013
JP 2013-051031 A 3/2013

OTHER PUBLICATIONS

Office Action in counterpart Japanese Patent Application No. 2013-073206 issued Nov. 22, 2016 (8 pages).

* cited by examiner

*Primary Examiner* — Jong-Suk (James) Lee
*Assistant Examiner* — Leah S Macchiarolo
(74) *Attorney, Agent, or Firm* — Osha Liang LLP

(57) ABSTRACT

A vehicular headlamp has a projection lens having an optical axis extending in a front-back direction, a light source disposed behind a rear side focal point of the projection lens, a reflector that reflects direct light from the light source toward the projection lens, a shade disposed between the projection lens and the light source, and that partially blocks light reflected from the reflector and to form a cut-off line of a light distribution pattern, a first reflective surface disposed in front of the reflector, that partially reflects direct light from the light source downward to the a front of the shade, and a second reflective surface disposed in front of the shade and lower than the rear side focal point of the projection lens, that reflects the light reflected from the first reflective surface toward the projection lens.

4 Claims, 5 Drawing Sheets

VEHICULAR HEADLAMP

CROSS-REFERENCE TO RELATED APPLICATION(S)

The present application claims the benefit of priority of Japanese Patent Application No. 2013-073206 filed on Mar. 29, 2013. The disclosures of the application are incorporated herein by reference.

BACKGROUND

Technical Field

The present disclosure relates to a vehicular headlamp.

Related Art

JP-A-2010-108727 (Patent Document 1) discloses a vehicular lamp that can form an overhead sign (OHS) light distribution pattern above a low-beam light distribution pattern. This lamp can illuminate a sign and the like positioned above a road surface even in the night.

SUMMARY

In such a vehicular lamp, a region immediately above a low-beam light distribution pattern becomes extremely darker than the low-beam light distribution pattern resulting in a great difference of brightness with respect to the low-beam light distribution pattern, and the inventor recognized that visibility in that region is insufficient.

One or more embodiments of the invention provide a vehicular headlamp that can form a light distribution pattern with high visibility.

A vehicular headlamp according to one or more embodiments of the invention comprises:

a projection lens having an optical axis extending in a front-back direction;

a light source disposed behind a rear side focal point of the projection lens;

a reflector configured to reflect direct light from the light source toward the projection lens;

a shade disposed between the projection lens and the light source, and configured to partially block light reflected from the reflector and to form a cut-off line of a light distribution pattern;

a first reflective surface provided in front of the reflector, and configured to partially reflect direct light from the light source downward to the front of the shade; and a second reflective surface provided in front of the shade and lower than the rear side focal point of the projection lens, and configured to reflect the light reflected from the first reflective surface toward the projection lens, wherein the first reflective surface has a front side first reflective surface, and a rear side first reflective surface provided behind the front side first reflective surface, and wherein the reflected light which is incident on the second reflective surface from the front side first reflective surface and reflected by the second reflective surface is caused to irradiate in front of a lamp so as to illuminate above the reflected light which is incident on the second reflective surface from the rear side first reflective surface and reflected by the second reflective surface.

According to a vehicular headlamp of one or more embodiments of the present invention, since light from a front side first reflective surface that is provided in a position with distance from a light source illuminates upward and light from a rear side first reflective surface that is provided in a position close to the light source illuminates downward, it is possible to obtain an OHS light distribution pattern which becomes darker in an ascending order from below to above. Moreover, a low-beam light distribution pattern which is brighter than the OHS light distribution pattern is formed below the OHS light distribution pattern. Accordingly, it is possible to achieve the vehicular headlamp that can form a light distribution pattern with high visibility.

In the vehicular headlamp, the second reflective surface may be formed to be continuous from the shade.

According to a vehicular headlamp of one or more embodiments of the present invention, the OHS light distribution pattern and the low-beam light distribution pattern can be formed close to each other, and thus, it is possible to further enhance the visibility of a region immediately above the low-beam light distribution pattern.

In the vehicular headlamp, the second reflective surface may include an upper side second reflective surface, and a lower side second reflective surface provided lower than the upper side second reflective surface, the upper side second reflective surface is configured to reflect the light reflected from the rear side first reflective surface, and the lower side second reflective surface is configured to reflect the light reflected from the front side first reflective surface.

According to a vehicular headlamp of one or more embodiments of the present invention, a degree of freedom in optical system design for irradiating light from the front side first reflective surface above light from the rear side first reflective surface.

In the vehicular headlamp, the second reflective surface may have a recessed surface shape along the shade.

According to a vehicular headlamp of one or more embodiments of the present invention, a second reflective surface is in a shape along a shade, and thus, it is possible to exhibit an excellent appearance when the vehicular headlamp is viewed from the front of the lamp.

The vehicular headlamp may further comprise a connection surface provided between the rear side first reflective surface and the reflector, the connection surface having a shape such that the direct light from the light source is not incident thereon.

According to a vehicular headlamp of one or more embodiments of the present invention, direct light from the light source is not reflected at a boundary between a rear side first reflective surface and a reflector, and thus, a driver in an oncoming vehicle is not affected by glare.

According to one or more embodiments of the invention, it is possible to a vehicular headlamp that can form a light distribution pattern with high visibility.

DETAILED DESCRIPTION

<Overall Configuration>

Figure 1:
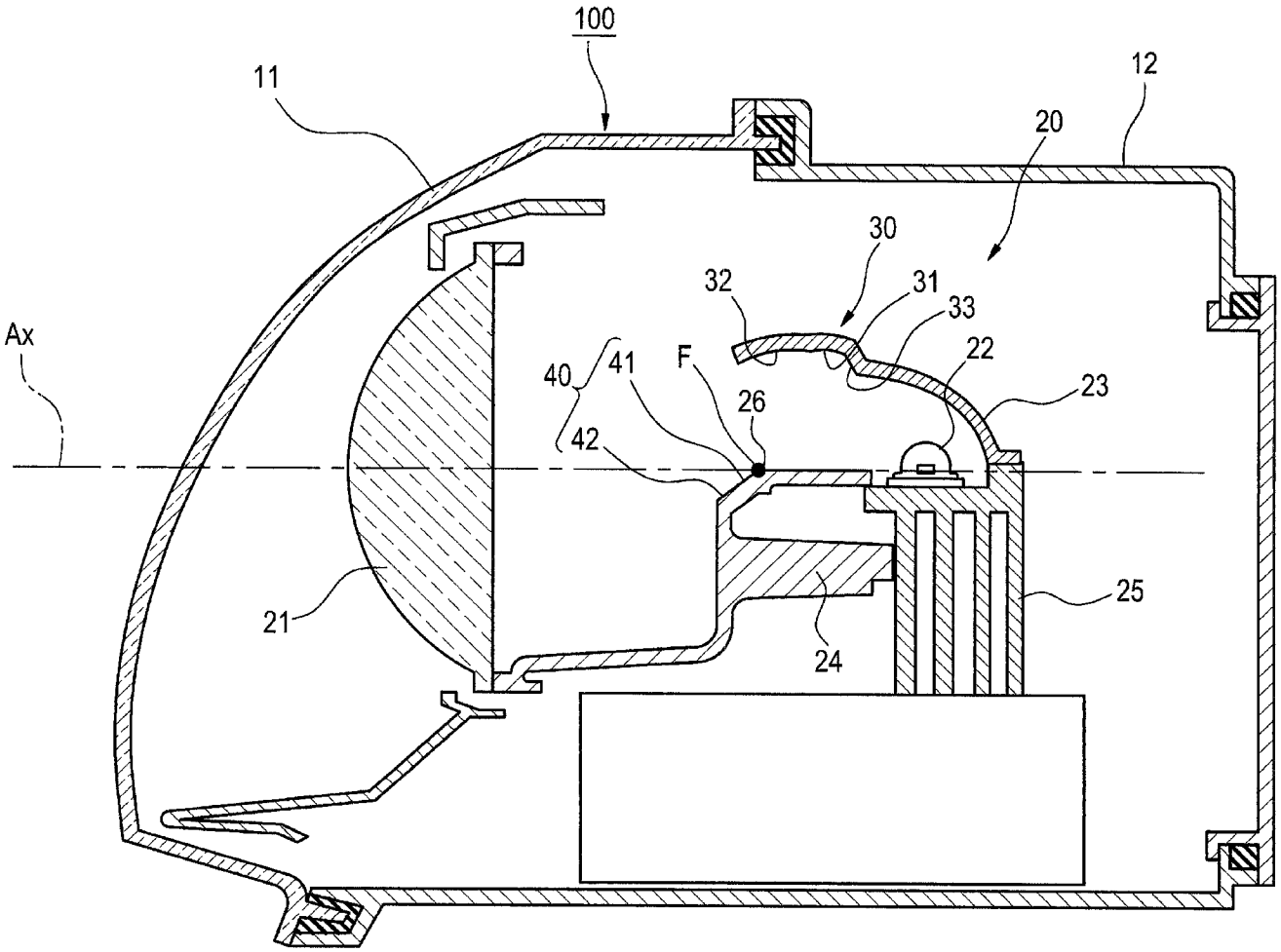
FIG. 1 is a side-sectional view of a vehicular headlamp according to one or more embodiments of the present invention.

Hereinafter, embodiments of the present invention will be described in detail with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 is a side-sectional view of a vehicular headlamp according to one or more embodiments of the present invention.

A vehicular headlamp 100 according to one or more embodiments of the present invention is a headlamp in which a low-beam light distribution pattern and an OHS light distribution pattern can be formed at the same time. The vehicular headlamp 100 includes a transparent outer cover 11, a lamp body 12 and a lamp unit 20. The lamp unit 20 is disposed inside a lamp chamber which is formed by the outer cover 11 and the lamp body 12.

The lamp unit 20 includes a projection lens 21, a light source 22, a reflector 23, a holder 24 and a heat sink 25. The projection lens 21, the light source 22, the reflector 23, the holder 24 and the heat sink 25 are integrally assembled, forming a unit.

The projection lens 21 is a planoconvex lens that has an optical axis Ax extending in a front-back direction of a vehicle. The projection lens 21 has a rear side focal point F on a rear side.

The light source 22 is disposed behind the rear side focal point F of the projection lens 21. In one or more embodiments of the present invention, the light source 22 is a laser emitting diode (LED), and a light emitting surface thereof faces upward. A semiconductor luminescent element, a halogen bulb, a discharge bulb and the like other than the LED may be adopted as a light source.

The reflector 23 is a reflective surface with a curved surface based on an elliptical surface. The reflector 23 is provided so as to cover an upper portion of the light source 22. The reflector 23 is provided with a first focal point to be positioned at the light source 22, and a second focal point to be in the vicinity of the rear side focal point F of the projection lens 21. Accordingly, the reflector 23 reflects direct light from the light source 22 toward the projection lens 21.

The heat sink 25 is attached to an opposite side of the light emitting surface of the light source 22. The heat sink 25 radiates heat, which is generated during light-emitting of the light source 22, inside the lamp chamber. In addition, the reflector 23 is attached to the heat sink 25.

The holder 24 is provided between the heat sink 25 and the projection lens 21. The heat sink 25 and the projection lens 21 are attached to the holder 24. An upper surface of the holder 24 is a horizontal surface along the optical axis Ax.

Figure 2:
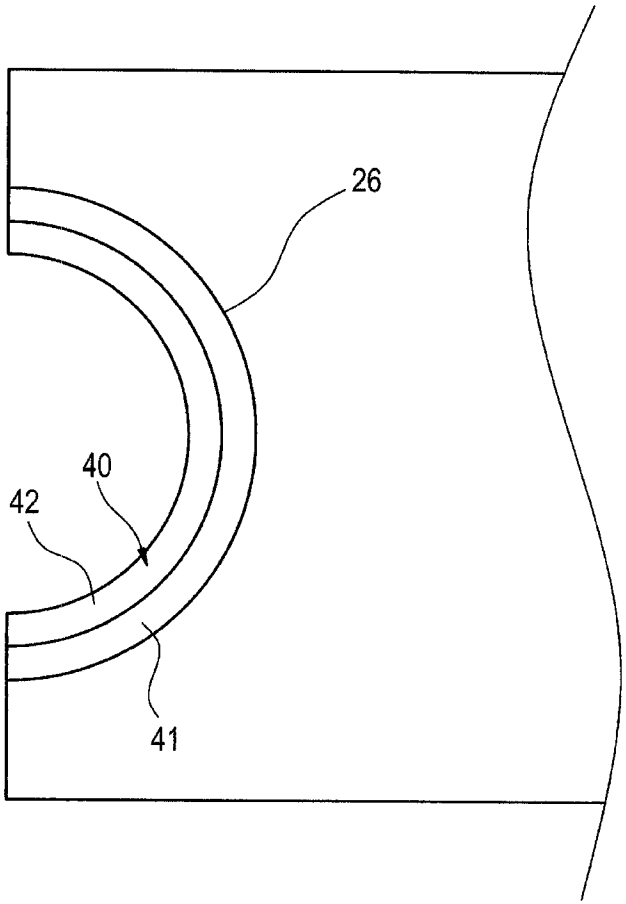
FIG. 2 is a top view of a shade in FIG. 1.

In addition, in the upper surface of the holder 24, a shade 26 is formed between the projection lens 21 and the light source 22. To be more specific, the shade 26 is provided in the vicinity of the rear side focal point F. A front end portion of the shade 26 forms a ridgeline of the upper surface and a front surface (second reflective surface 40) of the holder 24. The shape of this ridgeline is a shape corresponding to a cut-off line of a low-beam light distribution pattern described below. In addition, this ridgeline is curved along a lateral direction (direction perpendicular to paper surface of FIG. 1) of the vehicular headlamp 100 so as to be concave on a rear side (as shown in FIG. 2).

The direct light emitted from the light source 22 is reflected toward the projection lens 21 by the reflector 23. Light reflected from this reflector 23 is partially blocked by the shade 26, thereby forming the cut-off line of the low-beam light distribution pattern.

(First Reflective Surface)

In front of the reflector 23, a first reflective surface 30 is formed integrally with the reflector 23. This first reflective surface 30 partially reflects the direct light from the light source 22 downward to the front of the shade 26. The first reflective surface 30 includes a rear side first reflective surface 31 which is provided at a tip of the reflector 23, and a front side first reflective surface 32 which is provided in front of the rear side first reflective surface 31.

In the rear side first reflective surface 31 which is a curved surface based on the elliptical surface, a first focal point is set at the light source 22, and a second focal point is set in the vicinity of the second reflective surface 40. Similarly, on the front side first reflective surface 32 which is the curved surface based on the elliptical surface, a first focal point is set at the light source 22, and a second focal point is set in the vicinity of the second reflective surface 40. The second focal point of the front side first reflective surface 32 is set to be positioned in front side of the second focal point of the rear side first reflective surface 31.

The reflector 23 is also the elliptically curved surface, and the rear side first reflective surface 31 is the elliptically curved surface as well, and thus, focal positions thereof are different from each other. For this reason, if the rear side first reflective surface 31 and reflector 23 are formed to be adjacent to each other, a step difference occurs. Therefore, in one or more embodiments of the present invention, the rear side first reflective surface 31 and the reflector 23 are connected to each other through a connection surface 33. This connection surface 33 is a tilted surface. The tilt angle of the connection surface 33 is set at an angle at which the direct light from the light source 22 is not incident on the connection surface 33.

(Second Reflective Surface)

The second reflective surface 40 is provided on a front side of the shade 26 and a side lower than the rear side focal point F of the projection lens 21. The second reflective surface 40 reflects the light reflected from the first reflective surface 30 toward the projection lens 21. This second reflective surface 40 is formed on the front surface of the holder 24 which extends downward and forward from the shade 26 to be continuous from the shade 26. The second reflective surface 40 is formed in a curved-line shape recessed from the optical axis Ax in a vertical section as illustrated.

The second reflective surface 40 has an upper side second reflective surface 41 which is formed to be adjacent to the shade 26, and a lower side second reflective surface 42 which is formed below and in front of the upper side second reflective surface 41.

FIG. 2 is a top view of the shade 26. As illustrated in FIG. 2, the second reflective surface 40 is in the curved surface shape recessed rearward in a horizontal direction. The curved surface of this second reflective surface 40 is in a shape corresponding to the shape of the front end portion (ridgeline) of the shade 26 extending to be curved in the lateral direction. As a result, the second reflective surface 40 is in the shape along the shade 26, thereby exhibiting an excellent appearance when the vehicular headlamp 100 is viewed from the front.

<Operation>

Figure 3:
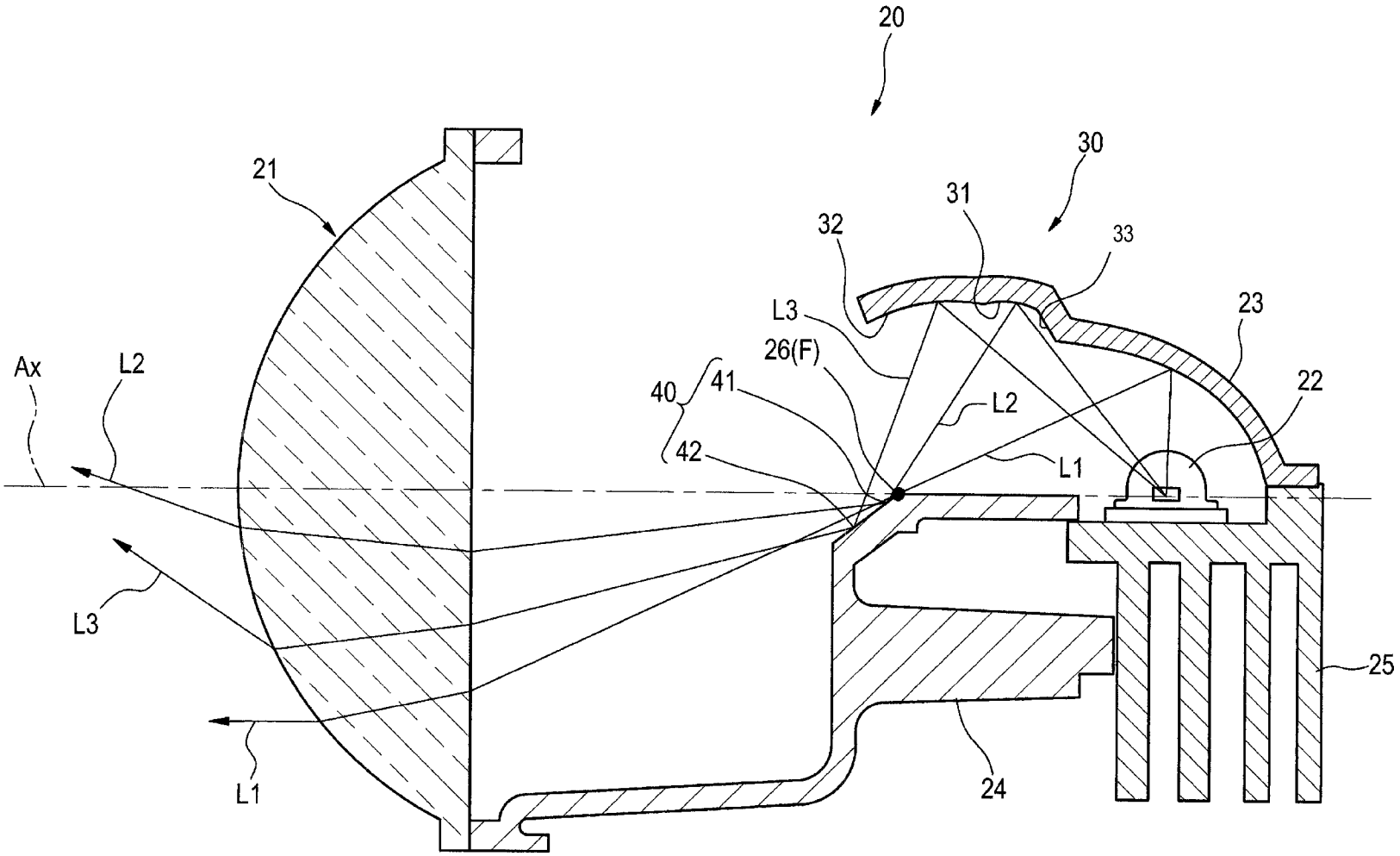
FIG. 3 is a partially enlarged view of FIG. 1.

Next, a path of light in the vehicular headlamp 100 which is configured as above will be described. FIG. 3 is a partially enlarged view of FIG. 1 illustrating the enlarged lamp unit 20.

As illustrated in FIG. 3, among rays of the direct light emitted from the light source 22, light L1 which is reflected by the reflector 23 is reflected toward the projection lens 21. The light L1 passes through the rear side focal point F, is emitted from the projection lens 21 toward the front of the lamp, and forms the low-beam light distribution pattern in the front of the lamp. In this case, the reflected light L1 of the reflector 23 is partially blocked by the shade 26, thereby forming the cut-off line in the low-beam light distribution pattern.

Among the rays of the direct light emitted from the light source 22, lights L2 and L3 which are incident on the first reflective surface 30 are reflected toward the second reflective surface 40. The second reflective surface 40 reflects these lights L2 and L3 toward the projection lens 21. These lights L2 and L3 caused to irradiate upward from the projection lens 21 to the front of the lamp form the OHS light distribution pattern.

Next, the path of the lights L2 and L3 will be described in more detail.

Among the rays of the direct light emitted from the light source 22, the light L2 which is incident on the rear side first reflective surface 31 on a side close to the light source 22 is reflected to the upper side second reflective surface 41 by the rear side first reflective surface 31. The upper side second reflective surface 41 reflects this light L2 toward the projection lens 21, and the projection lens 21 emits the light L2 upward to the front of the lamp.

Among the rays of the direct light emitted from the light source 22, the light L3 which is incident on the front side first reflective surface 32 on a side far from the light source 22 is reflected to the lower side second reflective surface 42 by the front side first reflective surface 32. The lower side second reflective surface 42 reflects this light L3 toward the projection lens 21, and the projection lens 21 emits the light L3 upward to the front of the lamp.

In the vehicular headlamp 100 according to one or more embodiments of the present invention, the first reflective surface 30 and the second reflective surface 40 are set to cause the light L3 to illuminate above the light L2 when irradiating in front of the lamp with the lights L2 and L3 through the projection lens 21. In other words, reflected light L3 which is incident on the second reflective surface 40 from the front side first reflective surface 32 to be reflected by the second reflective surface 40 is caused to irradiate to illuminate above reflected light L2 which is incident on the second reflective surface 40 from the rear side first reflective surface 31 to be reflected by the second reflective surface 40.

As illustrated in FIG. 3, the reflector 23, the rear side first reflective surface 31 and the front side first reflective surface 32 are positioned in places closer to the light source 22 in the listed order. Since the direct light emitted from the light source 22 spreads in a radial manner, light intensity thereof decreases as the light source is away from the light source 22. Therefore, the light intensity of the reflected light L1 of the reflector 23 is the greatest, and the light intensity of the reflected light L3 of the front side first reflective surface 32 is the least. The light intensity of the reflected light L2 of the rear side first reflective surface 31 is less than the light intensity of the reflected light L1 and greater than the light intensity of the reflected light L3.

Figure 4:
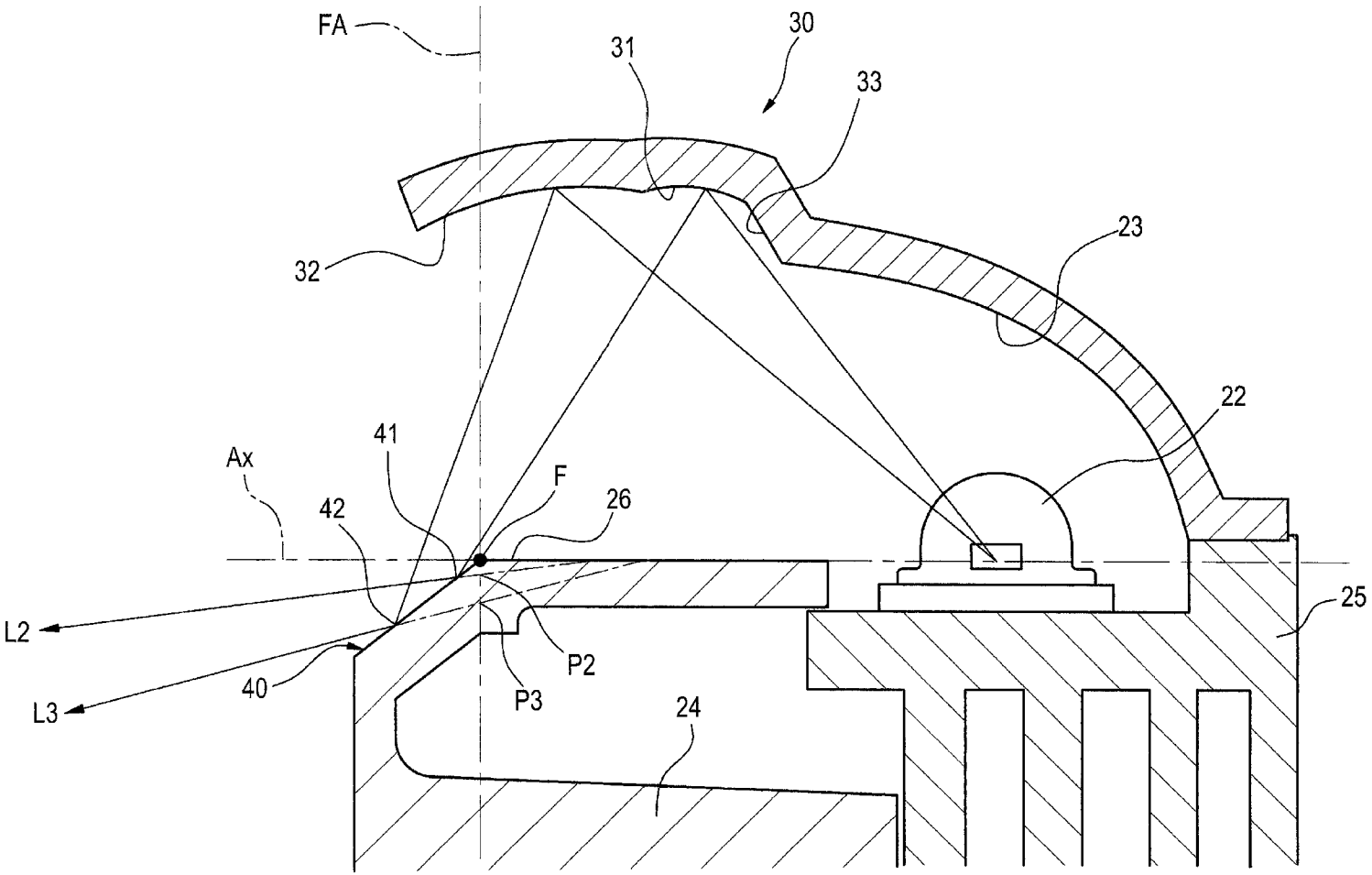
FIG. 4 is a partially enlarged view of FIG. 3.

FIG. 4 is a partially enlarged view of FIG. 3 illustrating the vicinity of the first reflective surface 30 and the second reflective surface 40. In FIG. 4, FA indicates a focal surface perpendicular to the optical axis Ax of the projection lens 21 passing through the rear side focal point F of the projection lens 21. The projection lens 21 projects an image which is formed on the focal surface FA by subjecting to vertical and horizontal inversions in front of the lamp. In other words, the projection lens 21 emits light, which is output from a point positioned lower than the optical axis Ax on the focal surface FA, above the optical axis Ax in front of the lamp. In addition, as this point is positioned lower, the projection lens 21 irradiates further above in the front of the lamp with the light output from the point.

Here, an intersection point, where a line segment in which the light L2 reflected from the upper side second reflective surface 41 extended to the focal surface FA intersects with the focal surface FA, is considered to be P2. Moreover, an intersection point, in which a line segment of the light L3 reflected from the lower side second reflective surface 42 extended to the focal surface FA intersects with the focal surface FA, is considered to be P3.

Then, in the vehicular headlamp 100 according to one or more embodiments of the present invention, as illustrated in FIG. 4, both of the intersection points P2 and P3 are positioned lower than the optical axis Ax. As a result, the reflected lights L2 and L3 illuminate above the optical axis Ax in front of the lamp. In addition, the intersection point P3 is positioned lower than the intersection point P2. Therefore, when the reflected light L3 is caused to irradiate the front of the lamp through the projection lens 21, the reflected light L3 illuminates above the reflected light L2.

As described above, the vehicular headlamp 100 according to one or more embodiments of the present invention forms the low-beam light distribution pattern using the reflected light L1 and forms the OHS light distribution pattern using the reflected lights L2 and L3.

Figure 5:
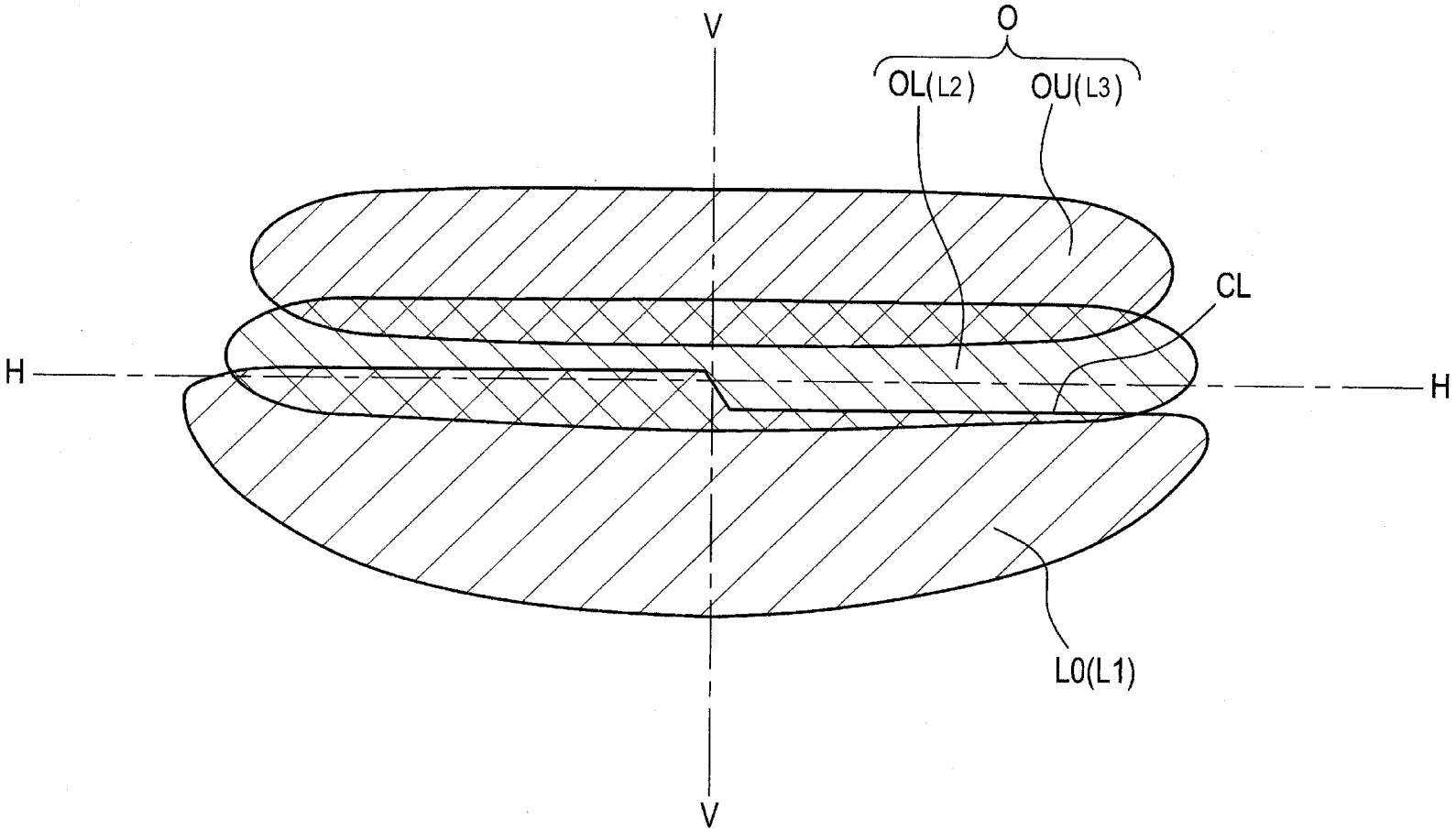
FIG. 5 is a schematic view illustrating a light distribution pattern.

FIG. 5 is a schematic view illustrating a light distribution pattern which is formed by the vehicular headlamp 100 according to one or more embodiments of the present invention. FIG. 5 is a view in which the light distribution pattern formed on a vertical screen which is provided in a position with a distance of 25 m from the lamp in front of the lamp is observed from the lamp side.

As illustrated in FIG. 5, in the lowermost portion in front of the lamp, a low-beam light distribution pattern Lo including a cut-off line CL is formed by the reflected light L1 from the reflector 23. Above this low-beam light distribution pattern Lo, an OHS light distribution pattern O is formed by the reflected lights L2 and L3 from the second reflective surface 40. In FIG. 5, each of the light distribution patterns Lo and OHS is illustrated apart from the other because each of the light distribution patterns Lo and OHS is illustrated by surrounding the region with specific intensity of illumination or higher, and thus, it is seen that each of the light distribution patterns Lo and OHS are continuous practically.

This OHS light distribution pattern O is configured to include an upper side OHS light distribution pattern OU and a lower side OHS light distribution pattern OL which is positioned lower than the upper side OHS light distribution pattern OU.

The upper side OHS light distribution pattern OU is formed by the reflected light L3 which is caused to irradiate above the reflected light L2 between the reflected lights L2 and L3 from the second reflective surface 40. The lower side OHS light distribution pattern OL is formed by the reflected light L2 which is caused to irradiate below the reflected light L3 between the reflected lights L2 and L3 from the second reflective surface 40.

As described above, the light intensity of the reflected light L1 of the reflector 23 is the greatest, and the light intensity of the reflected light L3 of the front side first reflective surface 32 is the least. The light intensity of the reflected light L2 of the rear side first reflective surface 31 is between the light intensity of the reflected light L1 and the light intensity of the reflected light L3. Therefore, in respect of the light distribution pattern formed in front of the lamp, the intensity of illumination of the low-beam light distribution pattern Lo is the greatest and the intensity of illumination of the upper side OHS light distribution pattern OU is the least. The intensity of illumination of the lower side OHS light distribution pattern OL is between the intensity of illumination of the low-beam light distribution pattern Lo and the intensity of illumination of the upper side OHS light distribution pattern OU.

In other words, the intensity of illumination of overall light distribution patterns including the low-beam light distribution pattern Lo and the OHS light distribution pattern O becomes less in an order from below to above. Therefore, in the boundaries between the light distribution patterns which are vertically adjacent to each other, that is, in a boundary between the low-beam light distribution pattern Lo and the lower side OHS light distribution pattern OL, or in a boundary between the lower side OHS light distribution pattern OL and the upper side OHS light distribution pattern OU, there occurs no remarkable change in the intensity of illumination.

In contrast, in the vehicular lamp disclosed in Patent Document 1, the front side first reflective surface reflects the direct light from the light source toward the upper side second reflective surface, and then, the upper side second reflective surface reflects this light to form a lower portion of the OHS light distribution pattern. In addition, the rear side first reflective surface reflects the direct light from the light source toward the lower side second reflective surface, and then, the lower side second reflective surface reflects this light above the reflected light by the upper side second reflective surface to form an upper portion of the OHS light distribution pattern.

Therefore, in the vehicular lamp disclosed in Patent Document 1, the upper region adjacent to the brightest low-beam light distribution pattern is irradiated by the darkest light reflected from the front side first reflective surface. Therefore, the remarkable change in the intensity of illumination immediately above the low-beam light distribution pattern occurs, thereby resulting in deterioration of visibility in the intensity of illumination immediately above the low-beam light distribution pattern. In addition, the uppermost region and the lowermost region are bright whereas the intermediate region is dark, thereby causing an unnatural appearance.

According to the vehicular headlamp 100 in one or more embodiments of the present invention, the upper region adjacent to the low-beam light distribution pattern Lo is irradiated by the light L2 reflected from the rear side first reflective surface 31. Therefore, the change of the intensity of illumination in the boundary therebetween is gentle, thereby achieving high visibility in the upper region adjacent to the low-beam light distribution pattern Lo.

In addition, in respect of the overall light distribution patterns formed by the vehicular headlamp 100 as well, since the intensity of illumination becomes lower from below to above, a natural appearance is achieved without giving a driver an uncomfortable feeling.

As described above, the image formed on the focal surface FA is subjected to the vertical and horizontal inversions by the projection lens 21 and is projected in front of the lamp. Therefore, as the intersection point P2 between the reflected light L2 forming the lower side OHS light distribution pattern OL and the focal surface FA is closer to the optical axis Ax, the center position of the lower side OHS light distribution pattern OL is closer to the low-beam light distribution pattern Lo.

According to the vehicular headlamp 100 in one or more embodiments of the present invention, as illustrated in FIG. 4, the second reflective surface 40 is formed to be continuous from the shade 26. Therefore, it is possible to cause the light L2 reflected from the rear side first reflective surface 31 to be incident on a position close to the shade 26 in the second reflective surface 40. Accordingly, the intersection point P2 can be adjacent to the optical axis Ax, and thus, it is possible to form the lower side OHS light distribution pattern OL close to the low-beam light distribution pattern Lo. Accordingly, the low-beam light distribution pattern Lo and the lower side OHS light distribution pattern OL are seen as being continuous. In addition, a difference in the intensity of illumination between the upper region adjacent to the low-beam light distribution pattern Lo and the low-beam light distribution pattern Lo decreases, thereby improving the visibility.

According to the vehicular headlamp 100 in one or more embodiments of the present invention, the second reflective surface 40 includes the upper side second reflective surface 41 and the lower side second reflective surface 42. Since the reflective surfaces are formed to be independent from each other, it is easy to control forming positions of the lower side OHS light distribution pattern OL which is formed by the reflected light L2 of the upper side second reflective surface 41 and the upper side OHS light distribution pattern OU which is formed by the reflected light L3 of the lower side second reflective surface 42.

Moreover, according to the vehicular headlamp 100 in one or more embodiments of the present invention, the upper side second reflective surface 41 reflects the light L2 reflected from the rear side first reflective surface 31, and the lower side second reflective surface 42 reflects the light L3 reflected from the front side first reflective surface 32. Since the reflective surfaces 31, 32, 41 and 42 can be designed to be independent from each other, a degree of freedom in design is enhanced. In addition, since the light L2 reflected from the rear side first reflective surface 31 is configured to be incident on the upper side second reflective surface 41, there is no need for the rear side first reflective surface 31 to be formed at a steep angle with respect to the optical axis Ax, and thus, it is possible to efficiently cause light to be incident on the upper side second reflective surface 41.

In addition, according to the vehicular headlamp 100 in one or more embodiments of the present invention, the second reflective surface 40 is in a recessed surface shape along the shade 26. Accordingly, the second reflective surface 40 and the shade 26 are uniformly designed, thereby exhibiting an excellent appearance when the vehicular headlamp 100 is viewed from the front.

According to the vehicular headlamp 100 in one or more embodiments of the present invention, the connection surface 33 between the rear side first reflective surface 31 and the reflector 23 is shaped not to allow the direct ray from the light source 22 to be incident thereon. Accordingly, since the direct light from the light source 22 is not incident on the connection surface 33, a driver and the like in an oncoming vehicle is not affected by unintended glare and the like by the light incident on the connection surface 33.

Particularly, when the rear side first reflective surface 31 is formed to be more depressed than the reflector 23, a great step difference is easily generated. However, since the rear side first reflective surface 31 and the reflector 23 are connected on the connection surface 33 on which the direct light from the light source 22 is not incident, a driver and the like in an oncoming vehicle is not affected by glare.

The present invention is not limited to the embodiments described above, and appropriate changes and modifications can be made within a scope of the present invention.

For example, above, although an example is described in which the first reflective surface 30 is integrally formed with the reflector 23 (as a single member), the invention is not limited thereto. The first reflective surface 30 may be configured to be of a member other than the reflector 23.

In addition, in FIG. 5, the light distribution pattern formed in a region where an own vehicle keeps to the left is illustrated for a description. However, in a region where the own vehicle keeps to the right, the vehicular headlamp according to one or more embodiments of the invention may be configured to form the light distribution pattern in FIG. 5 subjected to the horizontal inversion.

In addition, in FIG. 5, although an example is described in which the shape of the OHS light distribution pattern O spreads from the center line V in the lateral direction, and the OHS light distribution pattern is formed across the entire region in front of a vehicle, the invention is not limited thereto. For example, the OHS light distribution pattern may be formed to irradiate specific region such as a left side portion of the center line V or a right side portion of the center line V. In this case, for example, if the second reflective surface 40 is formed at only another vehicle lane side (only a portion forming light distribution on own vehicle lane side) from the optical axis Ax in the lateral direction, it is possible to form the OHS light distribution pattern O in only the upper portion of the light distribution on the own vehicle lane side (left side portion).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicular headlamp comprising:

a projection lens having an optical axis extending in a front-back direction;

a light source disposed behind a rear side focal point of the projection lens;

a reflector configured to reflect direct light from the light source toward the projection lens;

a shade disposed between the projection lens and the light source, and configured to partially block light reflected from the reflector and to form a cut-off line of a light distribution pattern;

a first reflective surface provided in front of the reflector, and configured to partially reflect direct light from the light source downward to the front of the shade; and a second reflective surface provided in front of the shade and lower than the rear side focal point of the projection lens, and configured to reflect the light reflected from the first reflective surface toward the projection lens, wherein the first reflective surface has a front side first reflective surface, and a rear side first reflective surface provided behind the front side first reflective surface, wherein the reflected light which is incident on the second reflective surface from the front side first reflective surface and reflected by the second reflective surface is caused to irradiate in front of a lamp so as to illuminate above the reflected light which is incident on the second reflective surface from the rear side first reflective surface and reflected by the second reflective surface, wherein the second reflective surface includes an upper side second reflective surface, and a lower side second reflective surface provided lower than the upper side second reflective surface, wherein the upper side second reflective surface is configured to reflect the light reflected from the rear side first reflective surface, and wherein the lower side second reflective surface is configured to reflect the light reflected from the front side first reflective surface.

2. The vehicular headlamp according to claim 1, wherein the second reflective surface is formed to be continuous from the shade.

3. The vehicular headlamp according to claim 1, wherein the second reflective surface has a recessed surface shape along the shade.

4. The vehicular headlamp according to claim 1, further comprising:

a connection surface provided between the rear side first reflective surface and the reflector, the connection surface having a shape such that the direct light from the light source is not incident thereon.

* * * * *